United States Patent [19]

Willay

[11] 4,446,563

[45] May 1, 1984

[54] COMPOSITE CRUCIBLE

[75] Inventor: Gerard Willay, Ars sur Moselle, France

[73] Assignee: Institut De Recherches De La Siderurgie Francaise, Saint-Germain-En-Laye, France

[21] Appl. No.: 271,179

[22] Filed: Jun. 8, 1981

[30] Foreign Application Priority Data

Jun. 12, 1980 [FR] France ..... 80 13111

[51] Int. Cl.[3] ..... F27B 14/10

[52] U.S. Cl. ..... 373/157

[58] Field of Search ..... 373/155, 156, 157, 164, 373/118, 11, 30; 219/10.49 R

[56] References Cited

U.S. PATENT DOCUMENTS

| | | | |
|---|---|---|---|
| 3,401,227 | 9/1968 | Dunlevy et al. | 373/155 |
| 3,484,840 | 12/1969 | Spoth et al. | 373/157 X |
| 3,649,734 | 3/1972 | Wilson | 373/11 |
| 4,202,400 | 5/1980 | Gigliotti, Jr. et al. | 219/10.49 R X |

*Primary Examiner*—Roy N. Envall, Jr.

*Attorney, Agent, or Firm*—Michael J. Striker

[57] ABSTRACT

A composite crucible for melting by an induction process samples to be analyzed is placed in the interior of an induction heating coil supplied with electric current ofhigh frequency. The composite crucible is constituted by two containers, one inserted into the other with a small play between the containers. The outer container is of platinum or a platinum alloy, and the inner container is of refractory material of good heat conductive characteristics, preferably vitreous carbon, and is destined to receive the sample to be melted.

5 Claims, 3 Drawing Figures

COMPOSITE CRUCIBLE

BACKGROUND OF THE INVENTION

The present invention relates to a composite crucible for melting samples to be analyzed by inductive means.

More or less automated apparatuses are already known for the production, by means of a fusion-dilution process, samples to be analyzed, for example non-metallic samples in form of pearls, destined to be analyzed by a fluorescence with X-rays.

Some of these known apparatuses utilize electrical energy and comprise for this reason fusion means constituted by a vertical induction bobbin excited by a current of high frequency and in the interior of which is placed the crucible containing the sample.

Such an automatic apparatus is described in the French Pat. No. 2,381,303 of the same inventor, which comprises an agitation system for the crucible by means of movement of the bobbin to homogenize the sample during the fusion. Subsequently, thereto the sample is cast into a scoop of solidification, which is preheated either in a temporary manner above the bobbin, or directly on a platform of casting on a second induction bobbin of a structure of a planar spiral.

The fushion crucible, as well as the cooling scoop, are of a material which has the following essential properties: A mechanical resistance at sufficient heat, compatible with the weight of the sample, a good conductivity of electricity and heat, and finally being in the most possible manner inoxidable and chemically inert, even at high temperatures necessary for the melting of the sample.

Considering these requirements on uses generally crucibles and scoops of noble metal, such as platinum or alloys of platinum. Such accessories are very expensive and, even if the scoop has a relatively long useful life, the crucibles have not, but must be replaced after a certain number of fusions depending on the conditions of their utilization. It has been ascertained that certain samples containing metallic phases such as zinc can lead to a rather quick degradation of the crucibles.

SUMMARY OF THE INVENTION

It is an object of the present invention to provide a multivalent crucible, that is a crucible corresponding better to the above-indicated specifications, in a manner so as to be able to accommodate samples of any nature and composition while prolonging the useful life of the crucible to a maximum. With these and other objects in view, which will become apparent as the description proceeds, the composite crucible according to the present invention for fushion of samples to be analyzed and destined to be placed into the interior of an induction coil to be connected to an electric current of high frequency, comprise an outer container of noble metal such as platinum or an alloy of platinum and an inner container removably placed into the outer container, preferably with a simple functional play between the two containers, in which the inner container is of refractory material of good heat conductive characteristics such as graphite, or preferably vitreous carbon, and destined to contain the sample to be melted.

In the following the expressions "container of platinum" or "retainer of graphite" are used to respectively designate the outer container and the inner container.

The present invention results from the following essential considerations:

In principle, in order to prolong the useful life of a crucible of platinum, and consequently thereto to reduce the cost for each fusion, it is necessary to generally use a crucible of platinum and to use a crucible of graphite only for such samples which would attack the platinum and which need not necessarily be melted in a platinum crucible but can be melted satisfactorily in a crucible of graphite. However, automatic apparatus equipped with electric means for melting the samples by induction, are not adapted to alternately receive a crucible of platinum and a crucible of graphite.

Indeed in such apparatus it is difficult to replace a crucible of platinum by a crucible of graphite and vice versa, since the generator providing a current of high frequency which is connected to the induction coil can be reconciled, by its construction, only to a secondary circuit of a determined nature which, generally, is of platinum. Under these conditions, the current generator can not be harmonized with a secondary circuit of graphite and in the majority of cases, this is not possible since it energizes likewise the bobbin to preheat the casting scoop which, practically, is necessarily formed of platinum.

In order to utilize such apparatus with a crucible of platinum and a crucible of graphite without modifying the material, has led the inventor to think about the problem and to find the solution, which is the object of the present invention, which consists, as already pointed out, to place a supplementary container of graphite into a permanent container of platinum.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
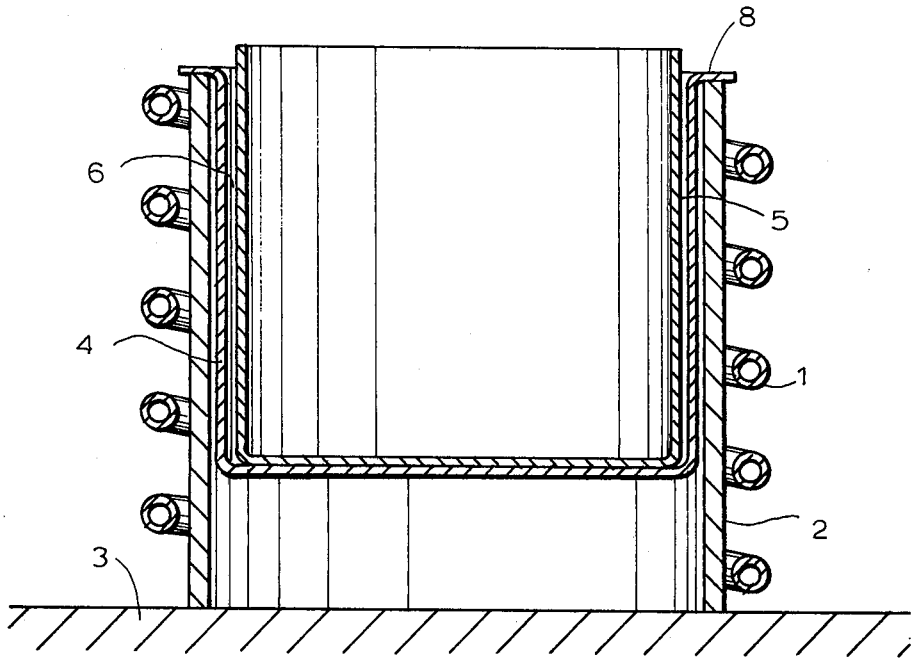
FIG. 1 is a vertical cross section through one modification of the crucible according to the present invention.

In the various Figures of the drawing, the composite crucible comprising the outer container 4 and the inner container 5 are surrounded by the induction coil 1 with a silica sleeve 2 interposed between the coil 1 and the outer container 4. The outer container 4 has at its upper end a laterally extending flange 8 which rests on the upper end of the silica sleeve 4 and the lower end of the latter, in turn, rests on the base 3.

When the induction coil 1 is excited by a current of high frequency in the order of a plurality of megahertz, from a source not shown in the drawing, a secondary current is produced at the outer container 4 of platinum and the inner container 5 of graphite reaches quickly the temperature of the outer container by heat exchange mainly produced by radiation. The indirect heating of the inner container 5 assures a satisfactory fusion of a sample contained therein, which is essentially as fast as during usual practice (in the order of a minute), but without the risk of deterioration of the outer container 4 of platinum, since the latter is not any longer in contact with the fused material which would be liable to damage the outer container.

It is to be understood that the use of an inner container 5 of graphite is less justified if the sample which has to be prepared is not of a chemical nature which can be reacted with platinum, and therefore the inner container 5 is arranged so as to be removable, if desired, from the outer container 4. Furthermore, the inner container 5 is used up considerably faster than the outer container 4 of platinum and must therefore more often be replaced.

Considering these facts, the inner container 5 is removably arranged in the outer container 4. Preferably the inner and the outer container are dimensioned so that a minimum functional play 6 will remain between the outer peripheral surface of the inner container and the inner peripheral surface of the outer container. This will assure that, despite the high temperature (about 1200° C.) the containers are subjected during the use, the inner container 5 of graphite is practically consumed only at the outer surface thereof.

Figure 3:
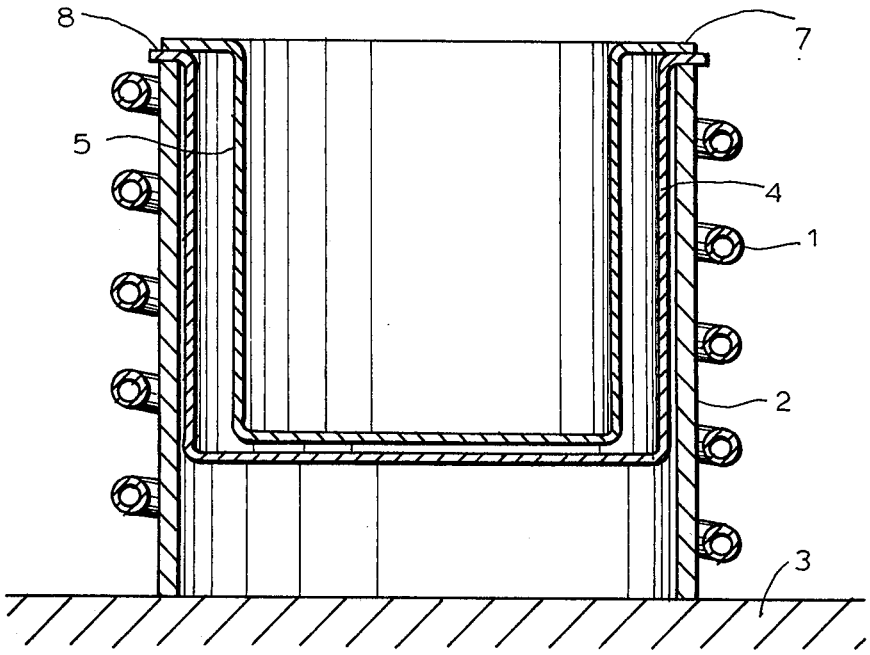
FIG. 3 is a vertical cross section through a slightly modified crucible according to the present invention.

It is to be understood, as shown in the embodiment illustrated in FIG. 3, that it is also possible to provide between the two containers a play or clearance greater than just a simple functional play. This construction, shown in FIG. 3, has the advantage to avoid a premature degradation of the inner container 5 of graphite by oxidation of its outer surface. This result may be obtained by various means, for instance by confining the atmosphere contained in the annular space between the outer surface of the inner container 5 and the inner surface of the outer container 4 by means of an annular flange 7 extending outwardly from the upper edge of the inner container 5 and abutting against the upper edge of the outer container 4 (which in addition avoids forming of rough edges on the outer container during discharge of the molten material), or it is also possible to replace this oxidizing atmosphere by an inert atmosphere by sweeping the aforementioned space with a neutral gas or, more generally, with a non-oxidizing gas.

In the embodiment shown in FIG. 3, the outer container 4 of platinum is likewise provided with a radially extending annular flange 8 which abuts at the upper edge of the sleeve 2, thus providing between the base 3 and the bottom of the outer container 4 a thermally insulating space. Further details with respect to these aspects, which actually are outside of the object of the present invention, can be noted from the text of the already mentioned French Pat. No. 2,381,303.

In accordance with the preferred realization of the present invention, the inner container 5 is made of vitreous carbon.

In this way the mechanical resistance of the inner container 5 is improved as compared with inner containers formed of conventional graphite, which permits especially to use at less risk an inner container with a thin wall (in the order of about 1 mm) and consequently, to practically obtain such a fast heating of the inner container as is obtained during use of only an outer container of platinum.

Furthermore, in contradistinction to the conventional graphite, vitreous carbon is practically not friable, so that entrainment of carbon particles detached from the wall of the inner container during casting of the sample is avoided, which would disturb the final analysis of the sample. It is further mentioned that, while the vitreous carbon is used up during successive fusing operations, but this wear is considerably less than that of conventional carbon, and it has its origin not in a mechanical erosion of the wall, but in a chemical reaction with oxygen causing liberation of CO or $CO_2$, which will not pollute the sample. Finally, vitreous carbon which has by definition the consistency of glass, presents non-wetting characteristics to the sample, which permits to recuperate during the casting all the metal, without the necessity to proceed with a subsequent cleaning of the container.

It has to be underlined that the major interest of the present invention, in its broadest sense, that is independent of the chemical nature of the material which forms the inner container, is the cost efficiency of the arrangement or, in other words, the economy of the unit cost of the fusion of the samples.

If, according to the prior art a crucible only of platinum is used, the cost of renewal of the used up crucible is about 75% of the value of the metal. The uses thus systematically loses a quarter of the price of the crucible, to which has to be added the cost of the machining per number of fusions realized with the new crucible. In this way the cost of one fusion operation can be estimated of more than 10 french francs at the present price of the platinum.

Experience has shown that with the composite crucible in accordance with the present invention with an interior crucible of about 1 mm thickness it is possible to produce about a dozen fusions with a graphite crucible and more than twenty fusions with an inner crucible of vitreous carbon before the inner crucible has to be replaced. If on the one hand the increased durability of the outer container of platinum and on the other hand the relatively small cost of the graphite container is taken into account, a 70% reduction of the cost per unit fusion can be calculated.

It is to be understood that the composite crucible of the present invention may be realized in various modifications as to the form and structure of the composite crucible.

Figure 2:
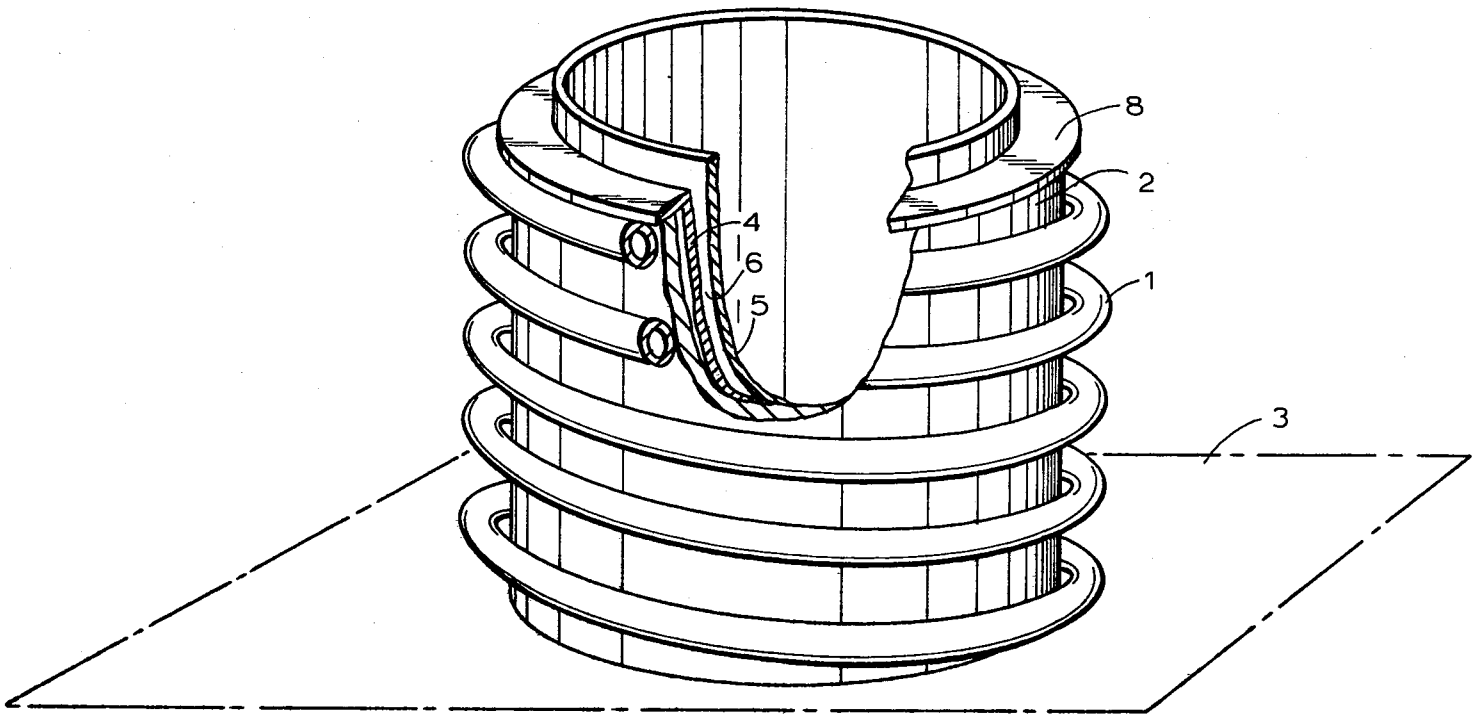
FIG. 2 is a perspective view of a crucible according to the present invention, with part of the crucible and the surrounding induction coil broken away.

Thus, the composite crucible may have any geometric form provided that the two containers forming the composite crucible can be inserted one into the other in such a manner that they can be easily separated and subsequently easily reassembled. In this respect the most advantageous form of the two containers is cylindrical. In the same way, as shown in FIGS. 1 and 2, the inner receptacle 5 may slightly project beyond the upper edge of the outer container 4 for a distance of a few millimeters, to thus facilitate its introduction and its removal from the outer container. This will also prevent, as does the flange 7 shown in FIG. 3, damage of the upper edge of the outer container during pouring out of the sample. This arrangement can be realized in different ways, for example, as shown in the Figures the inner container may have a height slightly superior to that of the outer container, or by placing at the bottom of the outer container a support of refractory material for instance a cushion of carbon packing, or an equivalent, on which the inner container rests to thus permit the increase of the desired height.

Finally, it will be noted that an inner container of graphite or of vitreous carbon is commercially produced so that it can be obtained without any difficulties.

It will be understood that each of the elements described above, or two or more together, may also find a useful application in other types of composite crucibles differing from the types described above.

While the invention has been illustrated and described as embodied in a composite crucible comprising an outer container of platinum and an inner container of graphite, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A composite crucible designed for the fusion of non metallic analytical samples by induction to be placed in an induction heating coil supplied with a high frequency electric current, comprising, two separate containers arranged in one another which can be separated, an outer container being made of a noble metal and a detachable inner container being made of a carbon material, said inner container having an upper end and said outer container having an opening with an edge; and means provided to form a closed space between the two containers, said conforming means comprising a flange disposed at said upper end of said inner container so that said inner container can bear against said edge of said opening of said outer container.

2. The crucible as in claim 1 wherein said confining means comprises a small play between said two containers to allow for their separation.

3. The crucible as in claim 1, wherein said inner container is made of vitreous carbon.

4. The crucible as in claim 1, wherein said outer container is made of platinum.

5. A composite crucible designed for the fusion of non metallic analytical samples by induction to be placed in an induction heating coil supplied with a high frequency electric current, comprising, two separate containers arranged in one another which can be separated, an outer container being made of a noble metal and a detachable inner container made of a carbon material; and means forming a closed space between the two containers, to prevent oxidation of the inner container.

* * * * *